US006026268A

United States Patent [19]

Shiozawa et al.

[11] Patent Number: 6,026,268

[45] Date of Patent: Feb. 15, 2000

[54] COLOR IMAGE FORMING APPARATUS WITH INTERMEDIATE TRANSFER MEMBER

[75] Inventors: Motohide Shiozawa, Mishima; Hideyuki Yano, Numazu, both of Japan

[73] Assignee: Canon Kabushiki Kaisha, Tokyo, Japan

[21] Appl. No.: 08/994,484

[22] Filed: Dec. 19, 1997

[30] Foreign Application Priority Data

Dec. 25, 1996 [JP] Japan ..... 8-345458

[51] Int. Cl.[7] ..... G03G 15/16

[52] U.S. Cl. ..... 399/297; 399/302; 399/308

[58] Field of Search ..... 399/99, 100, 101, 399/129, 297, 302, 308, 356

[56] References Cited

U.S. PATENT DOCUMENTS

| | | | |
|---|---|---|---|
| 5,153,654 | 10/1992 | Yuminamochi et al. | 399/318 |
| 5,177,549 | 1/1993 | Ohtsuka et al. | 399/320 |
| 5,264,902 | 11/1993 | Suwa et al. | 399/333 |
| 5,646,718 | 7/1997 | Suwa et al. | 399/350 |
| 5,732,310 | 3/1998 | Hiroshima et al. | 399/101 |

*Primary Examiner*—William Royer
*Assistant Examiner*—William A. Noē
*Attorney, Agent, or Firm*—Fitzpatrick, Cella, Harper & Scinto

[57] ABSTRACT

The present invention relates to the cleaning of an intermediate transfer member of an image forming apparatus for transferring a toner image formed on a photosensitive member onto the intermediate transfer member and then transferring the toner image onto a transfer material. An effective cleaning width of a cleaning means for removing residual toner remaining on the photosensitive member in a widthwise direction of the photosensitive drum is selected to become greater than a longitudinal dimension of the intermediate transfer member, the longitudinal dimension of the intermediate transfer member is selected to become greater than a width of a transfer electrode for transferring the toner image on the intermediate transfer member, and the longitudinal dimension of the intermediate transfer member is selected to become greater than a charge width of an electrode for charging the residual toner on the intermediate transfer member to return the toner to the photosensitive member.

9 Claims, 2 Drawing Sheets

320mm
CLEANING EFFECTIVE WIDTH

310mm
INTERMEDIATE TRANSFER DRUM 2

300mm
CHARGE ROLLER 4

300mm
(297mm)
TRANSFER ROLLER 3a

COLOR IMAGE FORMING APPARATUS WITH INTERMEDIATE TRANSFER MEMBER

BACKGROUND OF THE INVENTION

1. Field of the Invention

The present invention relates to an electrophotographic image forming apparatus with an intermediate transfer member, which can be applied to a printer, a facsimile device, a copying machine and the like.

2. Related Background Art

FIG. 2 shows a main part of an electrophotographic full-color image forming apparatus (full-color printer) with an intermediate transfer system. In FIG. 2, around a photosensitive drum (image bearing member) 1, there are disposed a first charge roller 7, a cleaner 6, an intermediate transfer drum 2, a color developing means 9 and a black developing device 8. Around the intermediate transfer drum 2, there are disposed a transfer belt 3 and a charge roller 4.

The cleaner 6 serves to remove waste toner from the photosensitive drum 1 and includes a cleaning blade 5 and a cleaner container 6*a*. The color developing means 9 includes a magenta developing device 9M containing magenta (M) color toner, an yellow developing device 9Y containing yellow (Y) color toner, and a cyan developing device 9C containing cyan (C) color toner. The black developing device 8 contains black (BK) color toner. In FIG. 2, the reference numeral 3*a* denotes a transfer roller.

A yellow color toner image, a magenta color toner image and a cyan color toner image formed on the photosensitive drum 1 (in some cases, a black toner image formed on the photosensitive drum 1) are temporarily transferred onto the intermediate transfer drum 2 in a superimposed fashion at a first transfer station between the photosensitive drum 1 and the intermediate transfer drum 2 to thereby form full-color images.

Then, the full-color images on the intermediate transfer drum 2 are collectively transferred onto a transfer material P at a second transfer station between the intermediate transfer drum 2 and the transfer belt 3. Residual toner (which has not been transferred) is adhered to a surface of the intermediate transfer drum 2 passed through the second transfer station. The residual toner is charged by the charge roller 4 and then is transferred onto the photosensitive drum 1 when the intermediate transfer drum is being passed through the first transfer station again. Ultimately, the residual toner is removed from the photosensitive drum 1 by the cleaning blade 5 of the cleaner 6 to be collected into the cleaner container 6*a*.

However, in the above-mentioned full-color printer when the printer is stopped, after the toner images are transferred to the intermediate transfer drum 2, for example due to sheet jam, if the transfer belt 3 is urged against the intermediate transfer drum 2 without interposition of the transfer material P, the toner is adhered to the transfer belt 3. As a result, the intermediate transfer drum 2 and the transfer material P are contaminated with toner during further printing operation to thereby output a poor image.

Further, if the residual toner is adhered to the charge roller 4, the residual toner is adhered to the intermediate transfer drum 2 again or is scattered to be adhered to the transfer material P during further printing operation to thereby output a poor image.

SUMMARY OF THE INVENTION

The present invention intends to eliminate the above-mentioned conventional drawbacks, and has an object to provide an image forming apparatus in which residual toner can be removed with a simple arrangement.

Another object of the present invention is to provide an image forming apparatus in which in addition to the waste toner on a transfer electrode for transferring toner images from an intermediate transfer member, the waste toner on the intermediate transfer member can be removed by a cleaning means for a photosensitive member.

To achieve the above objects, an image forming apparatus for transferring a toner image formed on a photosensitive member onto an intermediate transfer member and then transferring the toner image onto a transfer material according to the present invention, comprises a cleaning means for removing residual toner remaining on the photosensitive member after the toner image on the photosensitive member has been transferred to the intermediate transfer member, a transfer electrode means for transferring the toner image transferred to the intermediate transfer member onto a transfer material, and an electrode means for charging toner remaining on the intermediate transfer member to return the toner remaining on the intermediate transfer member to the photosensitive member by re-transferring, after the toner image on the intermediate transfer member was transferred. Wherein an effective cleaning width of the cleaning means in a width-wise direction of the photosensitive member is greater than a dimension of the intermediate transfer member in the width-wise direction, and the dimension of the intermediate transfer member in the width-wise direction is greater than a charge width of the transfer electrode means for transferring the toner image on the intermediate transfer member, and the dimension of the intermediate transfer member in the width-wise direction is greater than a charge width of the electrode means for charging the residual toner on the intermediate transfer member.

DETAILED DESCRIPTION OF THE PREFERRED EMBODIMENTS

The present invention will now be explained with reference to the accompanying drawings.

Figure 1:
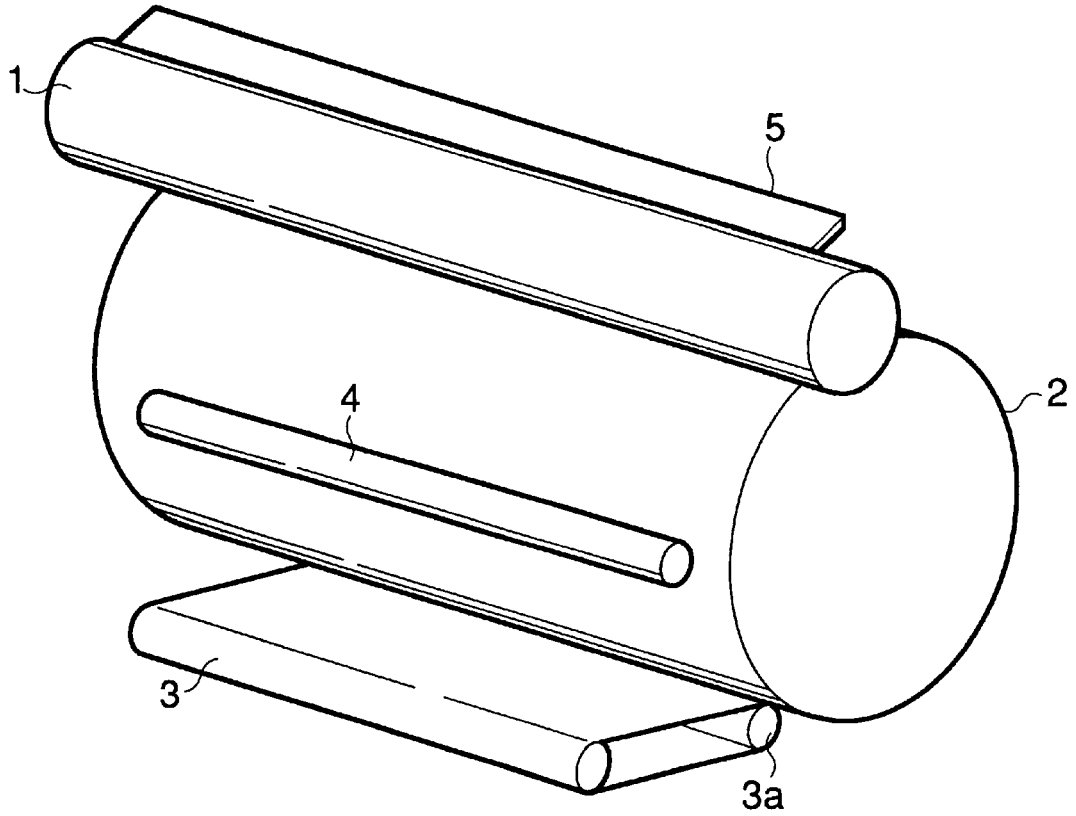
FIG. 1 is a perspective view showing a main part (dimensional relation between a photosensitive drum, a cleaning blade, an intermediate transfer drum and a charge roller) of an image forming apparatus (fullcolor printer) according to the present invention.
Figure 2:
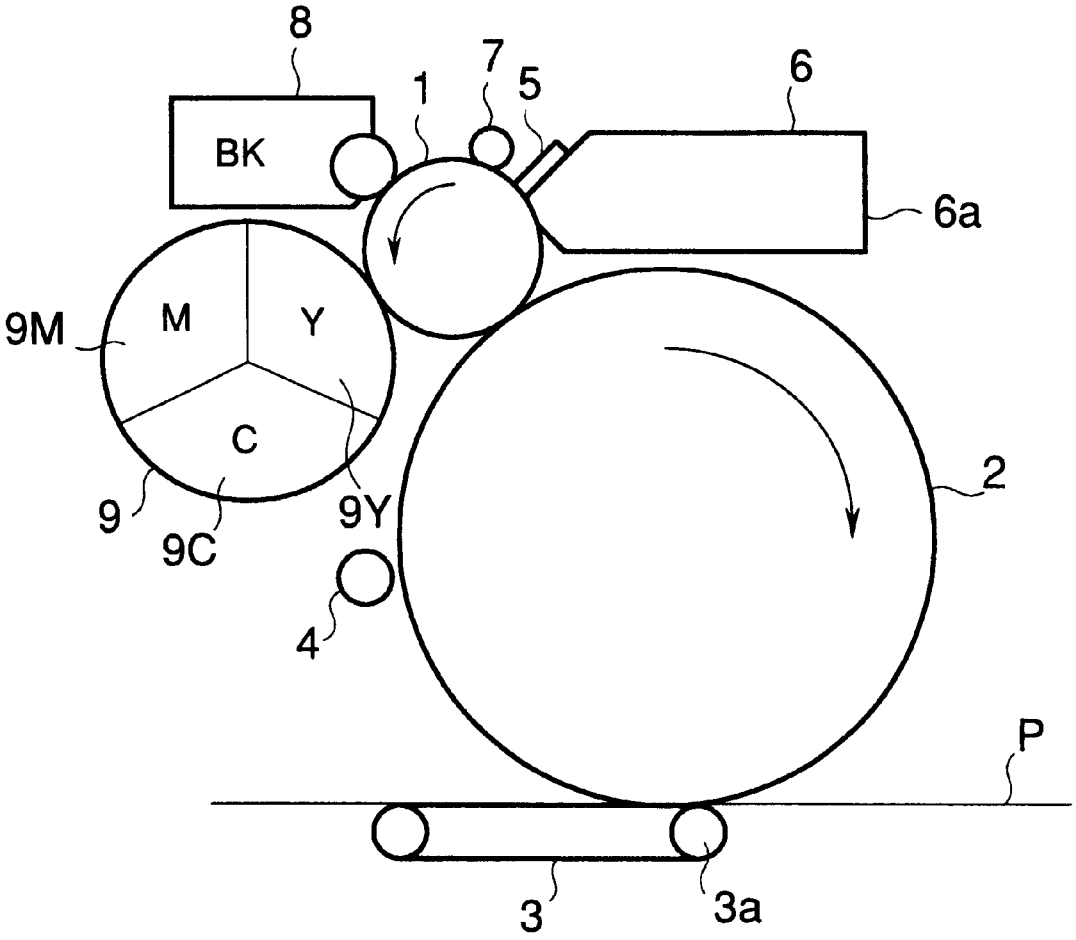
FIG. 2 is a perspective view showing a construction of the main part of the image forming apparatus (full-color printer) according to the present invention.

FIG. 1 is a perspective view showing a main part of a full-color printer according to the present invention. Since the fundamental arrangement of the full-color printer according to the present invention is the same as that of the conventional printer shown in FIG. 2, FIG. 2 is also referred to.

In FIG. 1, around a photosensitive drum 1, there are disposed a cleaning blade 5 and an intermediate transfer drum 2. Around the intermediate transfer drum 2, there are disposed a transfer belt 3 and a charge roller 4.

While the photosensitive drum 1 is being rotated, a surface of the photosensitive drum is uniformly charged by a first charge roller 7 (refer to FIG. 2) with −600 V ($V_D$ portion), and then, an image pattern is illuminated onto the surface of the photosensitive drum by an exposure means (not shown). As a result, surface potential of the exposed portion of the photosensitive drum 1 becomes −250 V ($V_L$ portion) to thereby form an electrostatic latent image corresponding to the image pattern (due to difference in surface potential). The electrostatic latent image is developed by the developing means 8, 9 with toner (minute particles) as a toner image. In the illustrated embodiment, the strongly exposed portion ($V_L$ portion) on the surface of the photosensitive drum 1 is developed by using negative toner having negative (−) charging polarity.

The toner image formed on the photosensitive drum 1 in this way is transferred onto the intermediate transfer drum 2 at a first transfer nip between the photosensitive drum 1 and the intermediate transfer drum 2. Bias voltage of +100 V is applied to the intermediate transfer drum 2, so that the toner image is transferred onto the intermediate transfer drum 2 due to potential difference of 350 V between the $V_L$ portion (−250 V) of the photosensitive drum 1 and the intermediate transfer drum 2 (+100 V). In this case, the first transferring efficiency is over 90%, and, thus, first transfer residual toner of several percent has adhered to the photosensitive drum 1.

The first transfer residual toner is removed from the photosensitive drum 1 by the cleaning blade 5 to thereby prepare for next image formation.

By repeating the above-mentioned process regarding yellow (Y) color, magenta (M) color, cyan (C) color and black (BK) color, four color toner images are formed on the intermediate transfer drum 2 in a superimposed fashion to thereby form a full-color image.

The full-color image formed on the intermediate transfer drum 2 in this way is transferred onto the transfer material (such as paper sheet) P at a second transfer nip between the intermediate transfer drum 2 and the transfer belt 3.

Explaining the transfer process in more detail, after the four color toner images were transferred to the intermediate transfer drum 2, the transfer belt 3 is urged against the intermediate transfer drum 2 from a rear side by means of the transfer roller 3*a*, and current of +20 $\mu$A is applied to the transfer roller 3*a*. In this condition, when the transfer material P is passed through the second transfer nip in synchrony with the image area, the four color toner images on the intermediate transfer drum 2 are transferred onto the transfer material P.

After the second transferring, second transfer residual toner is adhered to the intermediate transfer drum 2. The charge roller 4 is urged against the intermediate transfer drum 2 passed through the second transfer nip, and current of +20 $\mu$A is applied to the charge roller due to DC bias overlapped with AC bias of 3 $kV_{PP}$ and 2 KHz. Consequently, the second transfer residual toner is charged positively (+) by the charge roller 4, so that the residual toner is transferred onto the photosensitive drum 1 which was charged negatively (−) due to the potential difference when the photosensitive drum is passed through the first transfer nip again. The toner transferred to the photosensitive drum 1 is scraped by the cleaning blade 5 of the cleaner 6 and then is collected into the cleaner container 6*a*.

Since the charge roller 4 charges the toner while contacting with the intermediate transfer drum 2, the toner may be adhered to the surface of the charge roller 4. The toner adhered to the charge roller 4 may worsen the charging effect or may be accumulated and scattered within the printer to smudge the transfer material P.

However, an additional cleaning sequence will make the DC component of the bias applied to the intermediate transfer drum 2 to −1000 V with a polarity opposite to that of the normal sequence so that the toner adhered to the charge roller 4 is re-transferred onto the intermediate transfer drum 2. In this case, if a longitudinal dimension of the charge roller 4 is greater than a longitudinal dimension of the intermediate transfer drum 2, the toner adhered to both ends of the charge roller 4 cannot be collected.

To avoid this, in the present invention, as shown in FIG. 1, the longitudinal dimension of the intermediate transfer drum 2 is selected to 310 mm which is greater than the longitudinal dimension (300 mm) of the charge roller 4. Thus, the toner adhered to the charge roller 4 can be re-transferred onto the intermediate transfer drum 2 through the entire longitudinal area of the charge roller 4.

After the images were transferred to the intermediate transfer drum 2, if the printer is stopped due to the sheet jam, since the transfer belt 3 is directly urged against the intermediate transfer drum 2 without interposition of the transfer material P, the toner images are adhered to the transfer belt 3. Also, the toner adhered to the transfer belt may worsen the transferring effect of the transfer belt 3 and may smudge the rear surface of the transfer material P when the transfer material passes through the transfer belt. In this case, a bias of −2 kV having polarity opposite to that of the normal sequence is applied to the transfer belt 3 by means of jam recovery sequence to thereby re-transfer the toner adhered to the transfer belt 3 to the intermediate transfer drum 2. In this case, if a contact dimension between the transfer belt 3 and the transfer roller 3*a* is greater than the longitudinal dimension of the intermediate transfer drum 2, the toner adhered to both ends of the transfer belt 3 cannot be collected.

To avoid this, in the illustrated embodiment, the longitudinal dimension of the intermediate transfer drum 2 is selected to 310 mm which is greater than a longitudinal dimension (300 mm) of the transfer roller 3*a*. Thus, the toner adhered to the transfer belt 3 can be re-transferred onto the intermediate transfer drum 2 through the entire longitudinal area of the transfer belt 3.

Further, in the illustrated embodiment, an effective cleaning width of the cleaning blade 5 for cleaning the photosensitive drum 1 is selected to 320 mm which is greater than the longitudinal dimension (310 mm) of the intermediate transfer drum 2. As a result, after all of toners re-transferred from the transfer belt 3 and the charge roller 4 are transferred onto the photosensitive drum 1, such toners can be removed and collected by the cleaner 6.

As mentioned above, in the illustrated embodiment, since the longitudinal dimension of the intermediate transfer drum 2 is greater than the longitudinal dimensions of the charge roller 4 and the transfer roller 3*a*, the toner adhered to the charge roller 4 and the transfer belt 3 can be re-transferred onto the intermediate transfer drum 2 through the entire longitudinal areas of the charge roller 4 and the transfer belt 3. Also, since the effective cleaning width of the cleaning blade 5 on the photosensitive drum 1 greater than the longitudinal dimension of the intermediate transfer drum 2, after all of the toner is re-transferred from the transfer belt 3 and the charge roller 4 to the intermediate transfer drum 2 are transferred onto the photosensitive drum 1, such toners can be removed by the cleaning blade 5 of the cleaner 6 and be collected into the cleaner container 6*a*. As a result, the poor image due to the presence of the residual toner can be prevented effectively.

Incidentally, when the longitudinal dimension of the charge roller 4 is selected to 300 mm and the longitudinal dimension of the transfer roller 3*a* is selected to 297 mm so that the longitudinal dimension of the charge roller 4 becomes greater than the longitudinal dimension of the transfer roller 3*a*, the toner re-transferred from the transfer belt 3 to the intermediate transfer drum 2 can be sufficiently charged by the charge roller 4 to thereby improve the toner transferring from the intermediate transfer drum 2 to the photosensitive drum 1.

As mentioned above, according to the present invention, since the longitudinal dimension of the intermediate transfer member is greater than the longitudinal dimensions of the charge member and the transfer member, the toner adhered to the charge member and the transfer member can be re-transferred onto the intermediate transfer member through the entire longitudinal areas of the charge member and the transfer member. Also, since the effective cleaning width of the cleaning member on the image bearing member is selected to become greater than the longitudinal dimension of the intermediate transfer member, after all of toner re-transferred from the charge member and the transfer member to the intermediate transfer member are transferred onto the image bearing member, such toners can be collected by the cleaning member, thereby preventing the poor image due to the presence of the residual toner.

Further, since the longitudinal dimension of the charge member is greater than the longitudinal dimension of the transfer member, the toner re-transferred from the transfer member to the intermediate transfer member can be sufficiently charged by the charge member to thereby improve the toner transferring from the intermediate transfer member to the image bearing member.

What is claimed is:

1. An image forming apparatus for transferring a toner image formed on a photosensitive member onto an intermediate transfer member and then transferring the toner image onto a transfer material, comprising:

cleaning means for removing residual toner remaining on said photosensitive member after the toner image on said photosensitive member is transferred to said intermediate transfer member;

transfer electrode means for transferring the toner image transferred to said intermediate transfer member onto the transfer material; and electrode means for charging toner remaining on said intermediate transfer member to return the toner remaining on said intermediate transfer member to said photosensitive member by re-transferring, after the toner image on said intermediate transfer member has been transferred;

wherein a longitudinal dimension of an effective cleaning width of said cleaning means is greater than a longitudinal dimension of said intermediate transfer member, the longitudinal dimension of said intermediate transfer member is greater than a longitudinal dimension of said transfer electrode means for transferring the toner image on said intermediate transfer member, and the longitudinal dimension of said intermediate transfer member is greater than a longitudinal direction of said electrode means for charging the residual toner on said intermediate transfer member.

2. An image forming apparatus according to claim 1, wherein the longitudinal dimension of said electrode means for charging the toner remaining on said intermediate transfer member is greater than a longitudinal dimension of said transfer electrode means for transferring the toner image on said intermediate transfer member.

3. An image forming apparatus according to claim 1, wherein said electrode means for charging the toner remaining on the intermediate transfer member is an electrode in contact with said intermediate transfer member.

4. An image forming apparatus according to claim 3, wherein said electrode in contact with said intermediate transfer member is a roller electrode.

5. An image forming apparatus for transferring a toner image formed on a photosensitive member onto an intermediate transfer member, and then transferring the toner image onto a transfer material, comprising:

a cleaning device for removing a residual toner remaining on said photosensitive member after the toner image on said photosensitive member is transferred to said intermediate transfer member;

a transfer electrode for transferring the toner image transferred to said intermediate transfer member onto the transfer material; and a charge electrode disposed downstream of a second transfer position between the intermediate transfer member and the transfer electrode and at an upstream side of a first transfer position between the photosensitive member and the intermediate transfer member and for charging toner remaining on said intermediate transfer member to return the toner remaining on said intermediate transfer member to said photosensitive member by retransferring, after the toner image on said intermediate transfer member has been transferred;

wherein a longitudinal dimension of an effective cleaning width of said cleaning means is greater than a longitudinal dimension of said intermediate transfer member, the longitudinal dimension of said intermediate transfer member is greater than a longitudinal dimension of said transfer electrode for transferring the toner image on said intermediate transfer member, and the longitudinal dimension of said intermediate transfer member is greater than the longitudinal dimension of said charge electrode for charging the residual toner on said intermediate transfer member.

6. An image forming apparatus according to claim 5, wherein the longitudinal dimension of said charge electrode for charging the toner remaining on said intermediate transfer member is greater than the longitudinal dimension of said transfer electrode for transferring the toner image on said intermediate transfer member.

7. An image forming apparatus according to claim 5, wherein said electrode for charging the toner remaining in the intermediate transfer member is a roller electrode.

8. An image forming apparatus according to claim 5, wherein plural color toner images are formed on said intermediate transfer member to be transferred onto the transfer material collectively.

9. An image forming apparatus according to claim 5, wherein said transfer electrode for transferring the toner image on said intermediate transfer member is a contact electrode contacted with the transfer material.

* * * * *

UNITED STATES PATENT AND TRADEMARK OFFICE

CERTIFICATE OF CORRECTION

PATENT NO. : 6,026,268

DATED : February 15, 2000

INVENTOR(S): MOTOHIDE SHIOZAWA, ET AL.

It is certified that error appears in the above-identified patent and that said Letters Patent is hereby corrected as shown below:

COLUMN 1:
Line 23, "an" should read --a--.

COLUMN 2:
Line 41, "(fullcolor" should read --(Full-color--.

COLUMN 3:
Line 31, "as" should read --as a--.

COLUMN 4:
Line 42, "toners" should read --the toner is--; and
Line 53, "greater" should read --is greater--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*